US008308339B2

(12) United States Patent
Karpetsky et al.

(10) Patent No.: US 8,308,339 B2
(45) Date of Patent: Nov. 13, 2012

(54) METHOD AND MEANS FOR PRECISION MIXING

(75) Inventors: Timothy P. Karpetsky, Towson, MD (US); John C. Berends, Jr., Bel Air, MD (US)

(73) Assignee: Science Applications International Corporation, San Diego, CA (US)

( * ) Notice: Subject to any disclaimer, the term of this patent is extended or adjusted under 35 U.S.C. 154(b) by 0 days.

(21) Appl. No.: 13/363,327

(22) Filed: Jan. 31, 2012

(65) Prior Publication Data

US 2012/0132669 A1 May 31, 2012

Related U.S. Application Data

(62) Division of application No. 12/153,358, filed on May 16, 2008, now Pat. No. 8,123,396.

(60) Provisional application No. 60/930,415, filed on May 16, 2007.

(51) Int. Cl.
*B01F 5/04* (2006.01)

(52) U.S. Cl. ..... 366/152.1; 366/167.1; 366/173.1

(58) Field of Classification Search ..... 366/151.1, 366/152.1, 152.2, 167.1, 173.1
See application file for complete search history.

(56) References Cited

U.S. PATENT DOCUMENTS

| | | | | |
|---|---|---|---|---|
| 3,226,092 | A | 12/1965 | Graham et al. | 366/113 |
| 3,708,661 | A | 1/1973 | Hansen et al. | 250/495 ZC |
| 4,000,918 | A | 1/1977 | Reker | 285/93 |
| 4,159,423 | A | 6/1979 | Kambara | 250/423 R |
| 4,209,696 | A | 6/1980 | Fite | 250/281 |
| 4,256,335 | A | 3/1981 | Nielsen, Jr. | 285/250 |
| 4,271,357 | A | 6/1981 | Bradshaw et al. | 250/287 |
| 4,300,004 | A | 11/1981 | Wissner et al. | 570/211 |
| 4,318,028 | A | 3/1982 | Perel et al. | 315/111.81 |
| 4,375,347 | A * | 3/1983 | Lombardo et al. | 425/10 |
| 4,468,468 | A | 8/1984 | Benninghoven et al. | 436/173 |
| 4,531,056 | A | 7/1985 | Labowsky et al. | 250/288 |
| 4,542,293 | A | 9/1985 | Fenn et al. | 250/288 |
| 4,546,253 | A | 10/1985 | Tsuchiya et al. | 250/288 |
| 4,789,783 | A | 12/1988 | Cook | 250/379 |
| 4,855,595 | A | 8/1989 | Blanchard | 250/287 |
| 4,888,482 | A | 12/1989 | Kato | 250/281 |
| 4,948,962 | A | 8/1990 | Mitsui et al. | 250/288 |

(Continued)

FOREIGN PATENT DOCUMENTS

GB 2127212 4/1984

(Continued)

OTHER PUBLICATIONS

Hanson, Eric, "How an Ink Jet Printer Works" [online], [retrieved on May 15, 2008], 5 pp., Retrieved from the Internet: http://www.imaging.org/resources/web_tutorials/inkjet_files/inkjet.cfm.

(Continued)

*Primary Examiner* — David Sorkin
(74) *Attorney, Agent, or Firm* — King & Spalding LLP

(57) ABSTRACT

An extremely dilute mixture of a liquid in a flowing fluid stream is prepared by forming tiny droplets of the liquid and injecting the droplets individually into the flowing stream. The rate at which liquid is added to the flowing stream is determined by the number of droplet forming units that are provided and upon the frequency with which the units are activated, allowing a precise digital control of the concentration of the liquid in the flowing fluid stream.

6 Claims, 2 Drawing Sheets

U.S. PATENT DOCUMENTS

| | | | | |
|---|---|---|---|---|
| 4,974,648 | A | 12/1990 | Propst | 144/24.13 |
| 4,976,920 | A | 12/1990 | Jacob | 422/23 |
| 4,977,320 | A | 12/1990 | Chowdhury et al. | 250/288 |
| 4,999,492 | A | 3/1991 | Nakagawa | 250/281 |
| 5,141,532 | A | 8/1992 | Sacks et al. | 95/87 |
| 5,142,143 | A | 8/1992 | Fite et al. | 250/288 |
| 5,164,704 | A | 11/1992 | Steen et al. | 340/539.17 |
| 5,168,068 | A | 12/1992 | Yanagisawa et al. | 436/134 |
| 5,171,525 | A | 12/1992 | Jacob | 422/23 |
| 5,192,865 | A | 3/1993 | Zhu | 250/288 |
| 5,280,175 | A | 1/1994 | Karl | 250/287 |
| 5,304,797 | A | 4/1994 | Irie et al. | 250/287 |
| 5,305,015 | A | 4/1994 | Schantz et al. | 347/47 |
| 5,306,910 | A | 4/1994 | Jarrell et al. | 250/286 |
| 5,338,931 | A | 8/1994 | Spangler et al. | 250/287 |
| 5,412,208 | A | 5/1995 | Covey et al. | 250/288 |
| 5,412,209 | A | 5/1995 | Otaka et al. | 250/310 |
| 5,436,446 | A | 7/1995 | Jarrell et al. | 250/288 |
| 5,485,016 | A | 1/1996 | Irie et al. | 250/288 |
| 5,541,519 | A | 7/1996 | Stearns et al. | 324/464 |
| 5,559,326 | A | 9/1996 | Goodley et al. | 250/288 |
| 5,581,081 | A | 12/1996 | Kato et al. | 250/288 |
| 5,587,581 | A | 12/1996 | Stroosnyder | 250/287 |
| 5,625,184 | A | 4/1997 | Vestal et al. | 250/287 |
| 5,684,300 | A | 11/1997 | Taylor et al. | 250/286 |
| 5,736,740 | A | 4/1998 | Franzen | 250/288 |
| 5,747,799 | A | 5/1998 | Franzen | 250/288 |
| 5,750,988 | A | 5/1998 | Apffel et al. | 250/288 |
| 5,753,910 | A | 5/1998 | Gourley et al. | 250/288 |
| 5,756,994 | A | 5/1998 | Bajic | 250/288 |
| 5,798,146 | A | 8/1998 | Murokh et al. | 427/458 |
| 5,828,062 | A | 10/1998 | Jarrell et al. | 250/288 |
| 5,838,002 | A | 11/1998 | Sheehan | 250/288 |
| 5,873,523 | A | 2/1999 | Gomez et al. | 239/3 |
| 5,892,364 | A | 4/1999 | Monagle | 324/464 |
| 5,903,804 | A | 5/1999 | Kirkpatrick et al. | 399/154 |
| 5,945,678 | A | 8/1999 | Yanagisawa | 250/423 F |
| 5,965,884 | A | 10/1999 | Laiko et al. | 250/288 |
| 5,986,259 | A | 11/1999 | Hirabayashi et al. | 250/288 |
| 6,040,575 | A | 3/2000 | Whitehouse et al. | 250/288 |
| 6,060,705 | A | 5/2000 | Whitehouse et al. | 250/288 |
| 6,107,628 | A | 8/2000 | Smith et al. | 250/292 |
| 6,124,675 | A | 9/2000 | Bertrand et al. | 315/111.91 |
| 6,147,345 | A | 11/2000 | Willoughby | 250/288 |
| 6,204,500 | B1 | 3/2001 | Whitehouse et al. | 250/287 |
| 6,207,954 | B1 | 3/2001 | Andrien, Jr. et al. | 250/288 |
| 6,223,584 | B1 | 5/2001 | Mustacich et al. | 73/23.41 |
| 6,225,623 | B1 | 5/2001 | Turner et al. | 250/286 |
| 6,239,428 | B1 | 5/2001 | Kunz | 250/287 |
| 6,278,111 | B1 | 8/2001 | Sheehan et al. | 250/288 |
| 6,309,610 | B1 | 10/2001 | Nejezchleb et al. | 422/186.04 |
| 6,359,275 | B1 | 3/2002 | Bertsch et al. | 250/281 |
| 6,455,846 | B1 | 9/2002 | Prior et al. | 250/288 |
| 6,462,338 | B1 | 10/2002 | Inatsugu et al. | 250/292 |
| 6,465,776 | B1 | 10/2002 | Moini et al. | 250/285 |
| 6,486,469 | B1 | 11/2002 | Fischer et al. | 250/288 |
| 6,495,823 | B1 | 12/2002 | Miller et al. | 250/286 |
| 6,512,224 | B1 | 1/2003 | Miller et al. | 250/286 |
| 6,534,765 | B1 | 3/2003 | Robb et al. | 250/288 |
| 6,537,817 | B1 | 3/2003 | Papen | 436/49 |
| 6,583,407 | B1 | 6/2003 | Fischer et al. | 250/288 |
| 6,583,408 | B2 | 6/2003 | Smith et al. | 250/288 |
| 6,593,570 | B2 | 7/2003 | Li et al. | 250/290 |
| 6,600,155 | B1 | 7/2003 | Andrien, Jr. et al. | 250/287 |
| 6,610,986 | B2 | 8/2003 | Hartley | 250/423 R |
| 6,649,907 | B2 | 11/2003 | Ebeling et al. | 250/288 |
| 6,683,301 | B2 | 1/2004 | Whitehouse et al. | 250/288 |
| 6,690,004 | B2 | 2/2004 | Miller et al. | 250/286 |
| 6,727,496 | B2 | 4/2004 | Miller et al. | 250/287 |
| 6,744,041 | B2 | 6/2004 | Sheehan et al. | 250/283 |
| 6,750,449 | B2 | 6/2004 | Marcus | 250/288 |
| 6,784,424 | B1 | 8/2004 | Willoughby et al. | 250/292 |
| 6,815,668 | B2 | 11/2004 | Miller et al. | 250/286 |
| 6,818,889 | B1 | 11/2004 | Sheehan et al. | 250/288 |
| 6,822,225 | B2 | 11/2004 | Xu et al. | 250/287 |
| 6,852,969 | B2 | 2/2005 | Marcus et al. | 250/288 |
| 6,852,970 | B2 | 2/2005 | Yamada et al. | 250/288 |
| 6,867,415 | B2 | 3/2005 | Hughey et al. | 250/288 |
| 6,878,930 | B1 | 4/2005 | Willoughby et al. | 250/281 |
| 6,888,132 | B1 | 5/2005 | Sheehan et al. | 250/288 |
| 6,910,797 | B2 | 6/2005 | Falcon | 366/127 |
| 6,914,243 | B2 | 7/2005 | Sheehan et al. | 250/288 |
| 6,943,347 | B1 | 9/2005 | Willoughby et al. | 250/288 |
| 6,949,740 | B1 | 9/2005 | Sheehan et al. | 250/288 |
| 6,949,741 | B2 | 9/2005 | Cody et al. | 250/288 |
| 6,972,407 | B2 | 12/2005 | Miller et al. | 250/287 |
| 6,998,605 | B1 | 2/2006 | Frazer et al. | 250/281 |
| 7,005,634 | B2 | 2/2006 | Shiokawa et al. | 250/288 |
| 7,041,966 | B2 | 5/2006 | Frazer et al. | 250/281 |
| 7,053,367 | B2 | 5/2006 | Tobita et al. | 250/288 |
| 7,057,168 | B2 | 6/2006 | Miller et al. | 250/287 |
| 7,060,976 | B2 | 6/2006 | Sheehan et al. | 250/288 |
| 7,064,320 | B2 | 6/2006 | Yamada et al. | 250/288 |
| 7,078,068 | B2 | 7/2006 | Book | 426/140 |
| 7,083,112 | B2 | 8/2006 | Ivri | 239/4 |
| 7,087,898 | B2 | 8/2006 | Willoughby et al. | 250/288 |
| 7,091,493 | B2 | 8/2006 | Hiraoka | 250/425 |
| 7,095,019 | B1 | 8/2006 | Sheehan et al. | 250/288 |
| 7,112,785 | B2 | 9/2006 | Laramee et al. | 250/288 |
| 7,112,786 | B2 | 9/2006 | Russ, IV et al. | 250/288 |
| 7,138,626 | B1 | 11/2006 | Karpetsky | 250/288 |
| 7,253,406 | B1 | 8/2007 | Sheehan et al. | 250/288 |
| 7,259,368 | B2 | 8/2007 | Frazer et al. | 250/281 |
| 7,274,015 | B2 | 9/2007 | Miller et al. | 356/508 |
| 7,429,731 | B1 | 9/2008 | Karpetsky | 250/288 |
| 7,576,322 | B2 | 8/2009 | Karpetsky et al. | 250/288 |
| 7,586,092 | B1 | 9/2009 | Karpetsky | 250/288 |
| 2002/0011560 | A1 | 1/2002 | Sheehan et al. | 250/283 |
| 2002/0175278 | A1 | 11/2002 | Whitehouse | 250/281 |
| 2002/0185593 | A1 | 12/2002 | Doring | 250/287 |
| 2002/0185595 | A1 | 12/2002 | Smith et al. | 250/288 |
| 2003/0034452 | A1 | 2/2003 | Fischer et al. | 250/288 |
| 2003/0038236 | A1 | 2/2003 | Russ, IV et al. | 250/288 |
| 2003/0197121 | A1 | 10/2003 | Turecek et al. | 250/281 |
| 2004/0161856 | A1 | 8/2004 | Handly | 436/177 |
| 2004/0245458 | A1 | 12/2004 | Sheehan et al. | 250/288 |
| 2005/0056775 | A1 | 3/2005 | Cody et al. | 250/281 |
| 2005/0196871 | A1 | 9/2005 | Cody et al. | 436/173 |
| 2006/0249671 | A1 | 11/2006 | Karpetsky | 250/288 |
| 2007/0084999 | A1 | 4/2007 | Miller et al. | 250/288 |
| 2007/0114389 | A1 | 5/2007 | Karpetsky et al. | 250/288 |
| 2008/0080302 | A1 | 4/2008 | Takahashi | 366/158.5 |
| 2008/0296493 | A1 | 12/2008 | Willoughby et al. | 250/288 |
| 2009/0294660 | A1 | 12/2009 | Whitehouse et al. | 250/288 |
| 2010/0059689 | A1 | 3/2010 | Horiike et al. | 250/425 |

FOREIGN PATENT DOCUMENTS

| | | |
|---|---|---|
| GB | 2288061 | 10/1995 |
| JP | 04215329 | 8/1992 |
| JP | 05203637 | 8/1993 |
| JP | 10088798 | 4/1998 |
| WO | WO 93/14515 | 7/1993 |
| WO | WO 98/07505 | 2/1998 |
| WO | WO 99/63576 | 12/1999 |
| WO | WO 00/08455 | 2/2000 |
| WO | WO 00/08456 | 2/2000 |
| WO | WO 00/08457 | 2/2000 |
| WO | WO 01/33605 A2 | 5/2001 |
| WO | WO 01/33605 A3 | 5/2001 |
| WO | WO 03/010794 | 2/2003 |
| WO | WO 2004/098743 | 11/2004 |
| WO | WO 2004/110583 | 12/2004 |
| WO | WO 2006/011171 | 2/2006 |
| WO | WO 2006/122121 | 11/2006 |
| WO | WO 2008/054393 | 5/2008 |

OTHER PUBLICATIONS

Le, Hue P., "Progress and Trends in Ink-Jet Printing Technology" [online], *Journal of Imaging Science and Technology*, vol. 42, No. 1, Jan./Feb. 1998 [retrieved on May 15, 2008], 28 pp, Retrieved from the Internet: http://www.imaging.org/resources/web_tutorials/inkjet.cfm.

Chemi-Ionization—Mass Spectrometry Terms, "Chemi-Ionization" [online], Dec. 26, 2005 [retrieved on Apr. 28, 2006], 1 p., Retrieved from the Internet: http://www.msterms.com/wiki/index.php?title=Chemi-Ionization.

Scott, R.P.W., "Gas Chromatography Detectors" [online], Part of the Chrom. Ed. Series, Subsection: Thermal Argon Detector, Copyright 2002-2005 [retrieved on Apr. 28, 2006], 7 pp., Retrieved from the Internet: http://www.chromatography-online.org/GC-Detectors/Ionization-Detectors/Thermal-Argon/rs61.html.
Scott, R.P.W., "Gas Chromatography Detectors" [online], Part of the Chrom. Ed. Series, Subsection: Macro Argon Detector, Copyright 2002-2005 [retrieved on Apr. 28, 2006], 10 pp., Retrieved from the Internet: http://www.chromatography-online.org/GC-Detectors/Ionization-Detectors/Macro-Argon/rs54.html.
Scott, R.P.W., "Gas Chromatography Detectors" [online], Part of the Chrom. Ed. Series, Subsection: Micro Argon Detector, Copyright 2002-2005 [retrieved on May 11, 2006], 6 pp., Retrieved from the Internet: http://www.chromatography-online.org/GC-Detectors/Ionization-Detectors/Micro-Argon/rs59.html.
Scott, R.P.W., "Gas Chromatography Detectors" [online], Part of the Chrom. Ed. Series, Subsection: The Helium Detector, Copyright 2002-2005 [retrieved on Apr. 28, 2006], 8 pp., Retrieved from the Internet: http://www.chromatography-online.org/GC-Detectors/Ionization-Detectors/Helium/rs64.html.
Akishev, Yu, et al., "Negative Corona, Glow and Spark Discharges in Ambient Air and Transitions Between Them," *Plasma Sources Sci. Technol*., vol. 14, pp. S18-S25 (2005).
Willoughby, Ross C., et al., "Transmission of Ions Through Conductance Pathways from Atmospheric Pressure," *Proceedings of the 52nd ASMS Conference on Mass Spectrometry and Allied Topics*, Nashville, Tennessee, 2 pp., May 23-27, 2004.
Sheehan, Edward W., et al., "Atmospheric Pressure Focusing," *Proceedings of the 52nd ASMS Conference on Mass Spectrometry and Allied Topics*, Nashville, Tennessee, 2 pp., May 23-27, 2004.
Benocci, R., et al., "I-V Characteristics and Photocurrents of a He Corona Discharge Under Flow Conditions," *J. Phys. D: Appl. Phys*., vol. 37, pp. 709-714 (2004).
Bokman, C. Fredrik, "Analytical Aspects of Atmospheric Pressure Ionization in Mass Spectrometry," Acta Universitatis Upsaliensis, *Comprehensive Summaries of Uppsala Dissertations from the Faculty of Science and Technology*, vol. 748, 46 pp., 2002.
Stach, J., et al., "Ion Mobility Spectrometry—Basic Elements and Applications," *International Journal for Ion Mobility Spectrometry*, IJIMS 5(2002)1, pp. 1-21, 2002.
Willoughby, R., Sheehan, E., Mitrovich, A., "A Global View of LC/MS," Global View Publishing, pp. 64-65, 470-471, Copyright 2002.
Hanley, Luke, et al., "Surface Mass Spectrometry of Molecular Species," *Journal of Mass Spectrometry*, vol. 34, pp. 705-723 (1999).
Steinfeld, Jeffrey I., et al., "Explosives Detection: A Challenge for Physical Chemistry," *Annual Review of Physical Chemistry*, vol. 49, pp. 203-232, Oct. 1998.
Niessen, W.M.A. and van der Greef, J., "Liquid Chromatography—Mass Spectrometry Principles and Applications," Marcel Dekker, Inc., New York, New York, pp. 339-341, Copyright 1992.
Hart, K. J., et al., "Reaction of Analyte Ions With Neutral Chemical Ionization Gas," *Journal of the American Society for Mass Spectrometry*, vol. 3, No. 5, pp. 549-557, 1992 (ISSN 1044-0305).
Bruins, A.P., "Mass Spectrometry With Ion Sources Operating at Atmospheric Pressure,"*Mass Spectrometry Reviews*, vol. 10, pp. 53-77, 1991.
Duckworth, D. C., et al., "Radio Frequency Powered Glow Discharge Atomization/Ionization Source for Solids Mass Spectrometry," *Analytical Chemistry*, vol. 61, No. 17, pp. 1879-1886, Sep. 1, 1989.
Beres, S.A., et al., "A New Type of Argon Ionisation Detector," *Analyst*, vol. 112, pp. 91-95, Jan. 1987.
Lovelock, J.E. and Lipsky, S.R., "Electron Affinity Spectroscopy—A New Method for the Identification of Functional Groups in Chemical Compounds Separated by Gas Chromatography," *J. Amer. Chem. Soc*., vol. 82, pp. 431-433, Jan. 20, 1960.
Lovelock, J.E., "A Sensitive Detector for Gas Chromatrography," *Journal of Chromatography*, vol. 1, pp. 35-46, 1958.
Lovelock, J.E., "Measurement of Low Vapour Concentrations by Collision with Excited Rare Gas Atoms," *Nature*, vol. 181, pp. 1460-1462, 1958.
"Principles of DC and RF Plasma Spraying" [online], 1 p., Retrieved from the Internet: http://wiv.vdi-bezirksverein.de/HenneVDI.pdf.
Leparoux, et al., "Investigation of Non-Oxide Nanoparticles by RF Induction Plasma Processing—Synthesis, Modelling and In-Situ Monitoring," *EMPA-Thun, Materials Technology*, 1 p.
Guimbaud, C., et al., "An APCI Ion Source to Monitor $HNO_3$ Under Ambient Air Conditions" [online], 1 p., Retrieved from the Internet: http://lch.web.psi.ch/pdf/anrepo3/19.pdf.
Laroussi, M., and Lu, X., "Room-Temperature Atmospheric Pressure Plasma Plume for Biomedical Applications," *Applied Physics Letters* 87, 113902, Sep. 8, 2005.
Lin, B., Sunner, J., "Ion Transport by Viscous Gas Flow Through Capillaries," *J. Am. Soc. Mass Spectrom. 5*, pp. 873-885 (1994).
Potjewyd, J., "Focusing of Ions in Atmospheric Pressure Gases Using Electrostatic Fields," Ph.D. Thesis, University of Toronto (1983).
Mahoney, J. F., et al., "A Theoretical and Experimental Basis for Producing Very High Mass Biomolecular Ions by Electrohydrodynamic Emission," *22nd IEEE Industry Applications Society Annual Meeting*, Atlanta, Georgia, Oct. 18-23, 1987.
Olivares, J. A., et al., "On-Line Mass Spectrometric Detection for Capillary Zone Electrophoresis," *Anal. Chem. 59*, pp. 1230-1232 (1987).
Lee, T. D., et al., "An EHD Source for the Mass Spectral Analysis of Peptides," *Proceedings of the 36th ASMS Conference on Mass Spectrometry and Allied Topics*, San Francisco, California, Jun. 5-10, 1988.
Smith, R. D., et al., "Capillary Zone Electrophoresis-Mass Spectrometry Using an Electrospray Ionization Interface," *Anal. Chem. 60*, pp. 436-441 (1988).
Lee, T. D., et al. "Electrohydrodynamic Emission Mass Spectra of Peptides," *Proceedings of the 37th ASMS conference on Mass Spectrometry and Allied Topics*, Miami Beach, Florida, May 21-26, 1989.
Mahoney, J. F., et al., "Electrohydrodynamic Ion Source Design for Mass Spectrometry: Ionization, Ion Optics and Desolvation," *Proceedings of the 38th ASMS Conference on Mass Spectrometry and Allied Topics*, Tucson, Arizona, Jun. 3-8, 1990.
Feng, X., et al., "Single Isolated Droplets with Net Charge as a Source of Ions," *J. Am. Soc. Mass Spectrom*, 11, pp. 393-399 (2000).
Schneider, B. B., et al., "An Atmospheric Pressure Ion Lens to Improve Electrospray Ionization at Low Solution Flow-Rates," *Rapid Commun. Mass Spectrom* 15, pp. 2168-2175 (2001).
Alousi, A., et al., "Improved Transport of Atmospheric Pressure Ions Into a Mass Spectrometer," *The Proceedings of the 50th ASMS Conference on Mass Spectrometry and Allied Topics*, Orlando Florida, Jun. 2-6, 2002.
Klesper, H., et al., "Intensity Increase in ESI MS by Means of Focusing the Spray Cloud onto the MS Orifice," *The Proceeding of the 50th ASMS Conference on Mass Spectrometry and Allied Topics*, Orlando, Florida, Jun. 2-6, 2002.
Schneider, B. B., et al., "An Atmospheric Pressure Ion Lens that Improves Nebulizer Assisted Electrospray Ion Sources," *J. Am. Soc. Mass Spectrom. 13*, pp. 906-913 (2002).
Hartley, F. T., et al., "NBS Detection in Air and Water," *Micro/Nano 8*, pp. 1, 2, and 8 (Dec. 2003).
Cody, R. B., et al., "Versatile New Ion Source for the Analysis of Materials in Open Air Under Ambient Conditions," *Anal. Chem. 77*, pp. 2297-2302 (2005).
McEwen, C. N., et al., "Analysis of Solids, Liquids, and Biological Tissues Using Solids Probe Introduction at Atmospheric Pressure . . . ," *Anal. Chem. 77*, pp. 7826-7831 (2005).
Cody, et al., "DART™: Direct Analysis in Real Time for Drugs, Explosives, Chemical Agents, and More . . . ," Sanibel Conference (American Society for Mass Spectrometry Sanibel Conference on Mass Spectrometry in Forensic Science and Counter-Terrorism), Clearwater, Florida, 39 pp., Jan. 28-Feb. 1, 2004.
Application as Filed for U.S. Appl. No. 12/400,831, filed Mar. 10, 2009, 53 pp.
Becker, K. H., et al., "Non-Equilibrium Air Plasmas at Atmospheric Pressure," Institute of Physics Publishing, Philadelphia, Pennsylvania, 42 pp., 2005 (Cover, Copyright Page, Table of Contents, and pp. 276-277, 286-293, and 328-350).
Application as Filed for U.S. Appl. No. 11/455,334, filed Jun. 19, 2006, 10 pp.

Application as Filed for U.S. Appl. No. 11/544,252, filed Oct. 7, 2006, 49 pp.
Application as Filed for U.S. Appl. No. 11/987,632, filed Dec. 3, 2007, 46 pp.
Application as Filed for U.S. Appl. No. 11/594,401, filed Nov. 8, 2006, 23 pp.
Application as Filed for U.S. Appl. No. 12/200,941, filed Aug. 29, 2008, 21 pp.
Application as Filed for U.S. Appl. No. 12/344,872, filed Dec. 29, 2008, 39 pp.

* cited by examiner

METHOD AND MEANS FOR PRECISION MIXING

CROSS-REFERENCE TO RELATED APPLICATIONS

This application is a divisional of U.S. patent application Ser. No. 12/153,358 entitled "METHOD AND MEANS FOR PRECISION MIXING," filed May 16, 2008 now U.S. Pat. No. 8,123,396, which claims the benefit of U.S. Provisional Patent Application No. 60/930,415 entitled "METHOD AND MEANS FOR PRECISION MIXING," filed May 16, 2007, both of which are incorporated herein by reference in their entirety.

BACKGROUND OF THE INVENTION

This invention relates generally to a method and means for introducing precisely measured quantities of a liquid into a moving fluid stream.

More specifically, this invention relates to a method and means for adding minute amounts of one or more liquids into a flowing fluid to obtain precise concentrations of the added liquids in the flowing fluid.

DESCRIPTION OF RELATED ART

Fluids containing precise amounts of one or more trace chemicals or reactants find common use as test atmospheres for calibrating gas analyzer systems, for addition of dopants or other reactant chemicals to the analyte in detector systems, for testing hazardous gas alarm systems, and for any other use that requires a minor, but stable and known, concentration of one or more trace chemicals or other additive compounds.

Gas mixtures for such purposes typically are either supplied to the end user as a compressed gas of defined composition contained in a high pressure cylinder or other container, or are prepared at or near the point of use. The use of compressed gas mixtures or standards is inconvenient and expensive in those situations where the calibration or other use requires multiple components and a range of trace chemical concentrations. Mutually reactive chemicals cannot be used in the same gas mixture and, in some cases, the concentration of the trace compound changes as the cylinder pressure changes or there is interaction between the trace compound and container surfaces.

Point of use preparation of a gas mixture of that kind is generally accomplished by means of a controlled permeation of a gas out of a permeation device and into a carrier gas. A permeation device is typically formed as a tube or other enclosure containing a pure chemical compound in a two-phase equilibrium between its gas phase and its liquid or solid phase. Part or all of the enclosure wall is constructed of a gas-permeable polymer such as Teflon. So long as the temperature remains constant, the rate at which the chemical compound diffuses through the permeable polymer is also substantially constant.

By maintaining the flow rate of the carrier gas into which the chemical compound diffuses constant there is then obtained a standardized mixture which may be used as a calibration gas, a test atmosphere and similar purposes. However, the use of permeation tubes to produce stable concentrations of trace amounts of a selected chemical in a gas mixture also has a number of drawbacks. In particular, production of a stable concentration of a trace chemical requires close control of the permeation tube temperature and of the flow rate of the carrier, or diluent, gas. Further, it is difficult to produce extremely dilute gas mixtures of precise composition using permeation devices.

It is evident that means and techniques for the preparation of precise concentrations of one or more trace chemicals in a flowing diluent fluid in a manner that is not sensitive to concentration, to temperature changes, or to diluent flow rate variations would offer substantial advantage over conventional methods. This invention provides those advantages.

SUMMARY OF THE INVENTION

Very small quantities of a liquid are mixed with much larger quantities of a flowing fluid stream by injecting individual droplets of the liquid into the flowing stream wherein the droplets instantly evaporate if the fluid is a gas, or rapidly disperse to form a homogeneous mixture if the fluid is a liquid. The droplets are formed either by applying an electrical pulse to a piezoceramic transducer within a nozzle causing a tiny droplet to be expelled from the nozzle, or by applying a current pulse to a heater element within a nozzle bore causing a vapor bubble to form, expand, and expel a droplet from the nozzle. The rate at which the liquid is expelled into the flowing stream is governed by the number of individual nozzles provided and by the frequency at which the nozzles are activated.

A first embodiment of the invention describes system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first liquid injection component including: a first liquid reservoir; a first exit port to the confined space; and a first subsystem for controllably injecting the first liquid from the first liquid reservoir through the first exit port into the confined space; wherein the first components in the fluid stream interact with second components in the first liquid.

The first embodiment including first components in the fluid stream that bind with second components in the first liquid.

The first embodiment including first components in the fluid stream that chemically react with and/or titrate second components in the first liquid.

The first embodiment including second components that modify reactions between the first components in the fluid stream and are selected from the group consisting of accelerants, decelerants, and catalysts.

The first embodiment wherein fluid in the fluid stream is a gas, the first liquid is water, and injecting the water into the gas stream controls the humidity of the gas stream.

The first embodiment including second components that modify the viscosity of the fluid stream.

The first embodiment wherein the first liquid has a lower viscosity than the viscosity of the fluid stream.

The first embodiment wherein the first components include particles which agglomerate during flow of the fluid stream and the second components include a surfactant for reducing agglomeration of the particles.

The first embodiment wherein the interaction between the first components and the second components results in a change of phase of at least one of the first components of the fluid stream.

The first embodiment wherein the second components include a flocculant.

The first embodiment wherein the second components are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

The first embodiment comprising a feedback control loop for controlling at least one of the frequency and size of the injected droplets in response to a signal from one or more sensors connected to the confined space.

The first embodiment wherein the confined space includes turbulence-inducing means for mixing the fluid stream with the first injected liquid.

A second embodiment of the invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first droplet forming device including: a first liquid reservoir; a first exit port to the confined space; and a first subsystem for controllably injecting the first liquid from the first liquid reservoir through the first exit port into the confined space, the first subsystem including: a first body member having a hole along the length thereof, the first exit port being at a first end of the first body member; a first transducer located near second end of the first body member; at least two first conductors for generating a pressure wave in response to an electrical pulse and causing the first transducer to deform, thereby forming a first liquid droplet at the first exit port and causing the first liquid droplet to be expelled into the fluid stream; a second droplet forming device for injecting in to the fluid stream within the confined space before the fluid stream reaches the use point, a second liquid containing third components, the second liquid injector including: a second liquid reservoir; a second exit port to the confined space; and a second subsystem for controllably injecting the second liquid from the second liquid reservoir through the second exit port into the confined space, the second subsystem including: a second body member having a hole along the length thereof, the second exit port being at a first end of the second body member; a second transducer located near second end of the second body member; at least two second conductors for generating a pressure wave in response to an electrical pulse and causing the second transducer to deform, thereby forming a second liquid droplet at the second exit port and causing the second liquid droplet to be expelled into the fluid stream; wherein the first components in the fluid stream interact with at least one of the second components in the first liquid and the third components in the second liquid.

A second embodiment further including a feedback control loop for controlling at least one of the frequency and size of the injected first and second droplets in response to a signal from one or more sensors connected to the confined space.

A second embodiment wherein the confined space includes turbulence-inducing means for mixing the fluid stream with the first and second injected liquids.

A second embodiment wherein the first and second liquids are different.

A second embodiment wherein the second and third components interact with each another.

A second embodiment wherein the first and second transducers are piezoceramic.

A second embodiment wherein the first components in the fluid stream bind with at least one of the second components in the first liquid and the third components in the second liquid.

A second embodiment wherein the first components in the fluid stream chemically react with, and/or titrate at least one of the second components in the first liquid and the third components in the second liquid.

A second embodiment wherein at least one of the second components in the first liquid and the third components in the second liquid modify reactions between the first components in the fluid stream and are selected from the group consisting of accelerants, deccelerants, and catalysts.

A second embodiment wherein the fluid in the fluid stream is a gas, at least one of the first and second liquids is water, and wherein injecting the water into the gas stream controls the humidity of the gas stream.

A second embodiment wherein at least one of the second components in the first liquid and the third components in the second liquid modify viscosity of the fluid stream.

A second embodiment wherein the first components include particles which agglomerate during flow of the fluid stream and at least one of the second components in the first liquid and the third components in the second liquid include a surfactant for reducing agglomeration of the particles.

A second embodiment wherein the interaction between the first components and at least one of the second components in the first liquid and the third components in the second liquid results in a change of phase of at least one of the first components of the fluid stream.

A second embodiment wherein at least one of the second components in the first liquid and the third components in the second liquid are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

A third embodiment of the invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first droplet forming device including: a first liquid reservoir; a first exit port to the confined space; and a first subsystem for controllably injecting the first liquid from the first liquid reservoir through the first exit port into the confined space, the first subsystem including: a first body member having a hole along the length thereof, the first exit port being at a first end of the first body member; a first resistance heater disposed within the hole; at least two first conductors for applying a current pulse to the first resistance heater and causing the temperature in the first liquid located within the hole to rise, thereby forming a vapor bubble in the first liquid resulting in a first liquid droplet being expelled into the fluid stream from the first exit port; a second droplet forming device for injecting in to the fluid stream within the confined space before the fluid stream reaches the use point, a second liquid containing third components, the second liquid injector including: a second liquid reservoir; a second exit port to the confined space; and a second subsystem for controllably injecting the second liquid from the second liquid reservoir through the second exit port into the confined space, the second subsystem including: a second body member having a hole along the length thereof, the second exit port being at a first end of the second body member; a second resistance heater disposed within the hole; at least two second conductors for applying a current pulse to the second resistance heater and causing the temperature in the second liquid located within the hole to rise, thereby forming a vapor bubble in the second liquid resulting in a second liquid droplet being expelled into the fluid stream from the second exit port; wherein the first components in the fluid stream interact with at least one of the second components in the first liquid and the third components in the second liquid.

A third embodiment further including a feedback control loop for controlling at least one of the frequency and size of the injected first and/or second droplets in response to a signal from one or more sensors connected to the confined space.

A third embodiment wherein the confined space including turbulence-inducing means for mixing the fluid stream with the first and second injected liquids.

A third embodiment wherein the first and second liquids are different.

A third embodiment wherein the second and third components interact with each another.

A third embodiment wherein the first components in the fluid stream bind with at least one of the second components in the first liquid and the third components in the second liquid.

A third embodiment wherein the first components in the fluid stream chemically react with and/or titrate at least one of the second components in the first liquid and the third components in the second liquid.

A third embodiment wherein at least one of the second components in the first liquid and the third components in the second liquid modify reactions between the first components in the fluid stream and are selected from the group consisting of accelerants, decelerants, and catalysts.

A third embodiment wherein the fluid in the fluid stream is a gas, at least one of the first and second liquids is water, and wherein injecting the water into the gas stream controls the humidity of the gas stream.

A third embodiment wherein at least one of the second components in the first liquid and the third components in the second liquid modify viscosity of the fluid stream.

A third embodiment wherein the first components include particles which agglomerate during flow of the fluid stream and at least one of the second components in the first liquid and the third components in the second liquid include a surfactant for reducing agglomeration of the particles.

A third embodiment wherein the interaction between the first components and at least one of the second components in the first liquid and the third components in the second liquid results in a change of phase of at least one of the first components of the fluid stream.

A third embodiment wherein at least one of the second components in the first liquid and the third components in the second liquid are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

A first, second or third embodiment wherein the fluid in the fluid stream being selected from the group consisting of a gas or a liquid.

A first, second or third embodiment wherein the use point being a detector, sensor, or sensor system.

A fourth embodiment of the invention describes a method for introducing a liquid into a fluid stream comprising: passing a fluid stream through a confined space connected at a first location to a fluid source and connected at a second location to use point; injecting a first liquid into the fluid stream within the confined space before the fluid stream reaches the use point, wherein injecting the first liquid into the fluid stream further includes electrically controlling a first droplet forming device to: generate a pressure wave, deform a transducer, form a liquid droplet at an exit port of the first droplet forming device; and cause the liquid droplet to be expelled into the fluid stream.

A fifth embodiment of the invention describes method for introducing a liquid into a fluid stream comprising: passing a fluid stream through a confined space connected at a first location to a fluid source and connected at a second location to use point; injecting a first liquid into the fluid stream within the confined space before the fluid stream reaches the use point, wherein injecting the first liquid into the fluid stream further includes electrically controlling a first droplet forming device to: generate a pressure wave, deform a transducer, form a liquid droplet at an exit port of the first droplet forming device; and cause the liquid droplet to be expelled into the fluid stream injecting a second liquid into the fluid stream within the confined space before the fluid stream reaches the use point, wherein injecting the second liquid into the fluid stream further includes electrically controlling a second droplet forming device to: generate a pressure wave, deform a transducer, form a liquid droplet at an exit port of the second droplet forming device, and expel the liquid droplet into the fluid stream.

A sixth embodiment of the invention describes method for introducing a liquid into a fluid stream comprising: passing a fluid stream through a confined space connected at a first location to a fluid source and connected at a second location to use point; injecting a first liquid into the fluid stream within the confined space before the fluid stream reaches the use point, wherein injecting the first liquid into the fluid stream further includes electrically controlling a first droplet forming device to: generate a pressure wave, deform a transducer, form a liquid droplet at an exit port of the first droplet forming device; and cause the liquid droplet to be expelled into the fluid stream injecting a second liquid into the fluid stream within the confined space before the fluid stream reaches the use point, wherein injecting the second liquid into the fluid stream further includes electrically controlling a second droplet forming device to: apply a current pulse to a resistance heater, cause the temperature in a liquid located within the second droplet forming device to rise, form a vapor bubble in the liquid, and expel a liquid droplet into the fluid stream from an exit port of the second droplet forming device.

A seventh embodiment of the invention describes method for introducing a liquid into a fluid stream comprising: passing a fluid stream through a confined space connected at a first location to a fluid source and connected at a second location to use point; injecting a first liquid into the fluid stream within the confined space before the fluid stream reaches the use point, wherein injecting the first liquid into the fluid stream further includes electrically controlling a first droplet forming device to: apply a current pulse to a resistance heater, cause the temperature in a liquid located within the second droplet forming device to rise, form a vapor bubble in the liquid, and expel a liquid droplet into the fluid stream from an exit port of the first droplet forming device; injecting a second liquid into the fluid stream within the confined space before the fluid stream reaches the use point, wherein injecting the second liquid into the fluid stream further includes electrically controlling a second droplet forming device to: apply a current pulse to a resistance heater, cause the temperature in a liquid located within the second droplet forming device to rise, form a vapor bubble in the liquid, and expel a liquid droplet into the fluid stream from an exit port of the second droplet forming device.

A fourth, fifth, sixth and seventh embodiment further comprising: sensing a characteristic of the fluid stream; signaling at least one of the first and second injections means in accordance with the sensed characteristic; and varying a size and or frequency of expulsion of the liquid droplet in response to the signaling.

A fourth, fifth, sixth and seventh embodiment further comprising detecting at least one characteristic of the fluid stream at the use point.

A fourth, fifth, sixth and seventh embodiment wherein the expelled liquid droplet reacts with a component of the fluid stream resulting in a change in the chemical composition thereof.

An eighth embodiment of the present invention describes a method for introducing a liquid into a fluid stream comprising: passing a fluid stream containing first components through a confined space connected at a first location to a fluid source and connected at a second location to use point; injecting a first liquid in amounts ranging from one picoliter to multiple milliliters into the fluid stream within the confined space before the fluid stream reaches the use point, the first liquid containing second components; wherein the first components in the fluid stream interact with second components in the first liquid.

An eighth embodiment further comprising causing the first components in the fluid stream to bind with second components in the first liquid.

An eighth embodiment further comprising causing first components in the fluid stream to chemically react with and/or titrate second components in the first liquid.

An eighth embodiment further comprising modifying reactions between the first components in the fluid stream by injecting a first liquid having second components selected from the group consisting of accelerants, deccelerants, and catalysts.

An eighth embodiment further comprising controlling the humidity in the fluid stream by injecting the water into the fluid stream.

An eighth embodiment further comprising modifying the viscosity of the fluid stream by injecting the first liquid into the fluid stream.

An eighth embodiment further comprising reducing agglomeration of the first components by injecting the first liquid into the fluid stream.

An eighth embodiment further comprising changing of phase of at least one of the first components of the fluid stream by injecting the first liquid into the fluid stream.

An eighth embodiment further comprising controlling at least one of the frequency and size of the injected droplets by sensing at least one characteristic of the fluid stream after injection of the first liquid therein.

An eighth embodiment further comprising mixing the fluid stream with the first injected liquid after injection of the first liquid therein.

A ninth embodiment of the present invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first droplet forming device including: a first liquid reservoir; a first exit port to the confined space; and a first subsystem for controllably injecting the first liquid from the first liquid reservoir through the first exit port into the confined space, the first subsystem including: a first body member having a hole along the length thereof, the first exit port being at a first end of the first body member; a first transducer located near second end of the first body member; and at least two first conductors for generating a pressure wave in response to an electrical pulse and causing the first transducer to deform, thereby forming a first liquid droplet at the first exit port and causing the first liquid droplet to be expelled into the fluid stream; wherein the first components in the fluid stream interact with the second components in the first liquid.

A ninth embodiment wherein the first components in the fluid stream bind with second components in the first liquid.

A ninth embodiment wherein the first components in the fluid stream chemically react with and/or titrate second components in the first liquid.

A ninth embodiment wherein the second components modify reactions between the first components in the fluid stream and are selected from the group consisting of accelerants, decelerants, and catalysts.

A ninth embodiment wherein the fluid in the fluid stream is a gas, the first liquid is water, wherein the injecting the water into the gas stream controls the humidity of the gas stream.

A ninth embodiment wherein the second components modify viscosity of the fluid stream.

A ninth embodiment wherein the first liquid has a lower viscosity than the viscosity of the fluid stream.

A ninth embodiment wherein the first components include particles which agglomerate during flow of the fluid stream and the second components include a surfactant for reducing agglomeration of the particles.

A ninth embodiment wherein the interaction between the first components and the second components results in a change of phase of at least one of the first components of the fluid stream.

A ninth embodiment wherein the second components include a flocculant.

A ninth embodiment wherein the second components are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

A ninth embodiment further comprising a feedback control loop for controlling at least one of the frequency and size of the injected droplets in response to a signal from one or more sensors connected to the confined space.

A ninth embodiment wherein the confined space includes turbulence-inducing means for mixing the fluid stream with the first injected liquid.

A ninth embodiment wherein the fluid in the fluid stream is selected from the group consisting of a gas or a liquid.

A ninth embodiment wherein the use point is a detector, sensor, or sensor system.

A tenth embodiment of the present invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first droplet forming device including: a first liquid reservoir; a first exit port to the confined space; and a first subsystem for controllably injecting the first liquid from the first liquid reservoir through the first exit port into the confined space, the first subsystem including: a first body member having a hole along the length thereof, the first exit port being at a first end of the first body member; a first resistance heater disposed within the hole; at least two first conductors for applying a current pulse to the first resistance heater and causing the temperature in the first liquid located within the hole to rise, thereby forming a vapor bubble in the first liquid resulting in a first liquid droplet being expelled into the fluid stream from the first exit port; wherein the first components in the fluid stream interact with the second components in the first liquid.

A tenth embodiment wherein the first components in the fluid stream bind with second components in the first liquid.

A tenth embodiment wherein the first components in the fluid stream chemically react with and/or titrate second components in the first liquid.

A tenth embodiment wherein the second components modify reactions between the first components in the fluid stream and are selected from the group consisting of accelerants, decelerants, and catalysts.

A tenth embodiment wherein the fluid in the fluid stream is a gas, the first liquid is water, and wherein the injecting the water into the gas stream controls the humidity of the gas stream.

A tenth embodiment wherein the second components modify viscosity of the fluid stream.

A tenth embodiment wherein the first liquid has a lower viscosity than the viscosity of the fluid stream.

A tenth embodiment wherein the first components include particles which agglomerate during flow of the fluid stream and the second components include a surfactant for reducing agglomeration of the particles.

A tenth embodiment wherein the interaction between the first components and the second components results in a change of phase of at least one of the first components of the fluid stream.

A tenth embodiment wherein the second components include a flocculant.

A tenth embodiment wherein the second components are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

A tenth embodiment further comprising a feedback control loop for controlling at least one of the frequency and size of the injected droplets in response to a signal from one or more sensors connected to the confined space.

A tenth embodiment wherein the confined space includes turbulence-inducing means for mixing the fluid stream with the first injected liquid.

A tenth embodiment wherein the fluid in the fluid stream is selected from the group consisting of a gas or a liquid.

A tenth embodiment wherein the use point is a detector, sensor, or sensor system.

An eleventh embodiment of the present invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in amounts ranging from one picoliter to multiple milliliters into the fluid stream within the confined space before the fluid stream reaches the use point, the first liquid containing second components, the first droplet forming device including: a first liquid reservoir; a first exit port to the confined space; and a first subsystem for controllably injecting the first liquid from the first liquid reservoir through the first exit port into the confined space, the first subsystem including: a first body member having a hole along the length thereof, the first exit port being at a first end of the first body member; a first transducer located near second end of the first body member; at least two first conductors for generating a pressure wave in response to an electrical pulse and causing the first transducer to deform, thereby forming a first liquid droplet at the first exit port and causing the first liquid droplet to be expelled into the fluid stream; a second droplet forming device for injecting a second liquid in amounts ranging from one picoliter to multiple milliliters into the fluid stream within the confined space before the fluid stream reaches the use point, the second liquid containing third components, the second droplet forming device including: a second liquid reservoir; a second exit port to the confined space; and a second subsystem for controllably injecting the second liquid from the second liquid reservoir through the second exit port into the confined space, the second subsystem including: a second body member having a hole along the length thereof, the second exit port being at a first end of the second body member; a second resistance heater disposed within the hole; at least two second conductors for applying a current pulse to the second resistance heater and causing the temperature in the second liquid located within the hole to rise, thereby forming a vapor bubble in the second liquid resulting in a second liquid droplet being expelled into the fluid stream from the second exit port; wherein the first components in the fluid stream interact with at least one of the second components in the first liquid and the third components in the second liquid.

An eleventh embodiment, further including a feedback control loop for controlling at least one of the frequency and size of the injected first and second droplets in response to a signal from one or more sensors connected to the confined space.

An eleventh embodiment wherein the confined space includes turbulence-inducing means for mixing the fluid stream with the first and second injected liquids.

An eleventh embodiment wherein the first and second liquids are different.

An eleventh embodiment wherein the second and third components interact with each another.

An eleventh embodiment the first and second transducers being piezoceramic.

An eleventh embodiment wherein the first components in the fluid stream bind with at least one of the second components in the first liquid and the third components in the second liquid.

An eleventh embodiment wherein the first components in the fluid stream chemically react with, and/or titrate at least one of the second components in the first liquid and the third components in the second liquid.

An eleventh embodiment wherein at least one of the second components in the first liquid and the third components in the second liquid modify reactions between the first components in the fluid stream and are selected from the group consisting of accelerants, deccelerants, and catalysts.

An eleventh embodiment wherein the fluid in the fluid stream is a gas, at least one of the first and second liquids is water, and wherein injecting the water into the gas stream controls the humidity of the gas stream.

An eleventh embodiment wherein at least one of the second components in the first liquid and the third components in the second liquid modify viscosity of the fluid stream.

An eleventh embodiment the first components include particles which agglomerate during flow of the fluid stream and at least one of the second components in the first liquid and the third components in the second liquid include a surfactant for reducing agglomeration of the particles.

An eleventh embodiment wherein the interaction between the first components and at least one of the second components in the first liquid and the third components in the second liquid results in a change of phase of at least one of the first components of the fluid stream.

An eleventh embodiment wherein at least one of the second components in the first liquid and the third components in the second liquid are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

A twelfth embodiment of the present invention describes a system for introducing a liquid into a fluid stream comprising: a fluid source; a confined space connected at a first location to the fluid source for passing a fluid stream containing first components there through, the confined space being connected at a second location to use point; a first droplet forming device for injecting a first liquid in the form of a first droplet in amounts ranging from one picoliter to multiple milliliters into the fluid stream within the confined space before the fluid stream reaches the use point, the first liquid containing second components; a second droplet forming device for injecting a second liquid in the form of a second droplet in amounts ranging from one picoliter to multiple milliliters into the fluid stream within the confined space before the fluid stream reaches the use point, the second liquid containing third components; wherein the first components in the fluid stream interact with at least one of the second components in the first liquid and the third components in the second liquid.

A twelfth embodiment, wherein the first droplet forming device includes: a first liquid reservoir; a first exit port to the confined space; and a first subsystem for controllably injecting the first liquid from the first liquid reservoir through the first exit port into the confined space; and the second droplet forming device including: a second liquid reservoir; a second exit port to the confined space; and a second subsystem for controllably injecting the second liquid from the second liquid reservoir through the second exit port into the confined space.

A twelfth embodiment, further including a feedback control loop for controlling at least one of the frequency and size of the injected first and second droplets in response to a signal from one or more sensors connected to the confined space.

A twelfth embodiment wherein the confined space includes turbulence-inducing means for mixing the fluid stream with the first and second injected liquids.

A twelfth embodiment wherein the first and second liquids are different.

A twelfth embodiment wherein the second and third components interact with each another.

A twelfth embodiment wherein the first components in the fluid stream bind with at least one of the second components in the first liquid and the third components in the second liquid.

A twelfth embodiment wherein the first components in the fluid stream chemically react with, and/or titrate at least one of the second components in the first liquid and the third components in the second liquid.

A twelfth embodiment wherein at least one of the second components in the first liquid and the third components in the second liquid modify reactions between the first components in the fluid stream and are selected from the group consisting of accelerants, deccelerants, and catalysts.

A twelfth embodiment wherein the fluid in the fluid stream is a gas, at least one of the first and second liquids is water, and wherein injecting the water into the gas stream controls the humidity of the gas stream.

A twelfth embodiment wherein at least one of the second components in the first liquid and the third components in the second liquid modify viscosity of the fluid stream.

A twelfth embodiment wherein the first components include particles which agglomerate during flow of the fluid stream and at least one of the second components in the first liquid and the third components in the second liquid include a surfactant for reducing agglomeration of the particles.

A twelfth embodiment wherein the interaction between the first components and at least one of the second components in the first liquid and the third components in the second liquid results in a change of phase of at least one of the first components of the fluid stream.

A twelfth embodiment wherein at least one of the second components in the first liquid and the third components in the second liquid are selected from the group consisting of: pure, dilute, or mixed chemicals; combinations of chemicals; biological materials including spores, bacteria, viruses, cells, cellular components, membranes, enzymes; and particulates including microspheres and microspheres coated with chemicals or biological materials.

DESCRIPTION OF PREFERRED EMBODIMENTS OF THE INVENTION

This invention comprises methods and means for the precisely controlled introduction of minute amounts, typically, from one picoliter to multiple milliliters, depending on the number of pumps and time involved, of a liquid into a flowing fluid stream. A multiplicity of tiny liquid droplets are individually injected into the fluid stream where the liquid quickly evaporates and comes to equilibrium if the fluid is a gas or, if the fluid is a liquid, rapidly disperses to form a substantially uniform mixture. The fluid stream may be any liquid stream or any gas stream, including two phase streams, such as gas or liquid streams containing solid particulates, at any temperature, pressure, or composition. Such fluid streams may contain neutral, charged and/or excited species, as well as proteins, enzymes, cells, and/or other macromolecular species, charged, uncharged, or excited.

The means for droplet injection into the fluid stream are small and light weight, consuming little power, and the rate at which liquid is introduced into the fluid stream is variable over a wide range, from one picoliter to multiple milliliters per unit time, depending on the number of pumps and volume of each droplet, and may be arranged to be under either analog or digital control.

Figure 1:
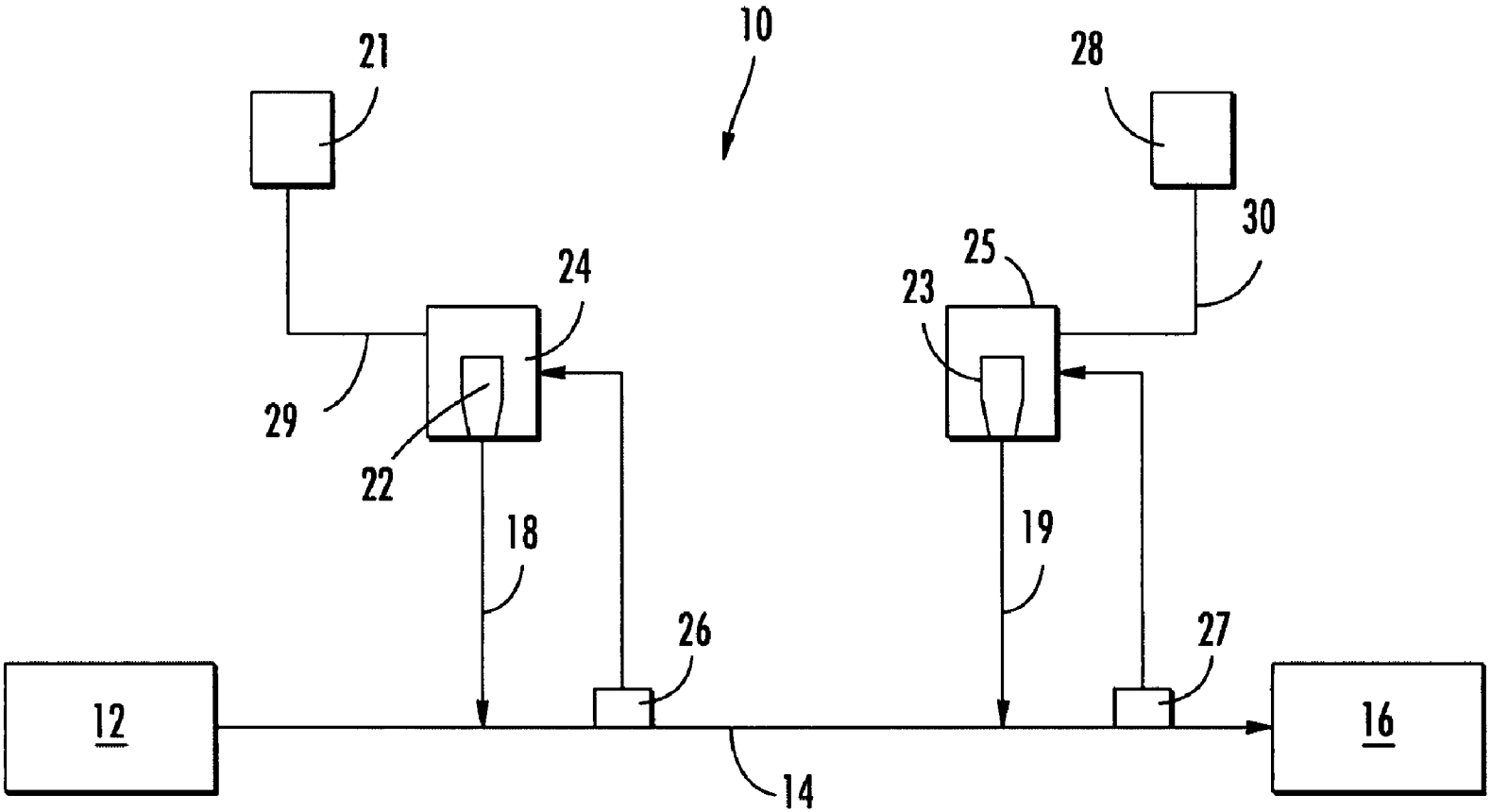
FIG. 1 is a diagrammatic representation of the mixing method and means of this invention.

A preferred embodiment of this invention will be described with reference to the drawing Figures in which FIG. 1 is a general representation at 10 of the means of this invention arranged for carrying out the described method of precision mixing. A fluid source 12 is arranged to communicate by way of confinement means 14 with a use point 16. Confinement means 14 may be a closed conduit, duct, or the like. A liquid injection port 18 is arranged to discharge individual tiny droplets created by droplet formation means 22 into a fluid stream flowing within confinement means 14. Port 18 comprises the outlet for droplet formation means 22. Means 22 may be disposed within a liquid reservoir 24 which in turn, is supplied via conduit means 29 with replacement liquid from source 21. Confinement means 14 can have a turbulence-inducing means, such as fins or baffles, to assist in the rapid mixing of the droplets from port 18 upon their entry into confinement means 14. Exemplary mixers include ISG, LPD and LLPD motionless mixers available from Ross & Son Company. Port 18 can be configured as part of a feedback control loop, in that it can be activated by signals from any point between the junction of 18 and 14 to the use point 16. For example, if a sensor or sensors 26 measure a chemical or physical property of the component(s) of the fluid that is modified by the addition of the droplets of liquid from port 18, changes in those properties can be used to control the frequency or size of droplet production and release into confinement means 14.

A second liquid injection port 19 may be provided downstream from port 18 to discharge individual tiny droplets created by droplet formation means 23 into the fluid stream flowing through confinement means 14. Means 23 may be disposed within a liquid reservoir 25 which is supplied by way of conduit 30 with replacement liquid from source 28. The liquid from source 28 may be the same as, but is ordinarily different from, the liquid from source 21 and, depending upon the application, the two liquids may either be inert toward or reactive with each other or with the flowing fluid stream or components in the flowing fluid stream. As described previously with respect to the first port 18, the second liquid injection port 19 can be configured as part of a feedback control loop including sensor or sensors 27 to measure a chemical or physical property of the component(s) of the fluid that is modified by the addition of the droplets of liquid from port 19. The sensed changes in those properties can be used to control the frequency or size of droplet production and release into confinement means 14.

Figure 2:
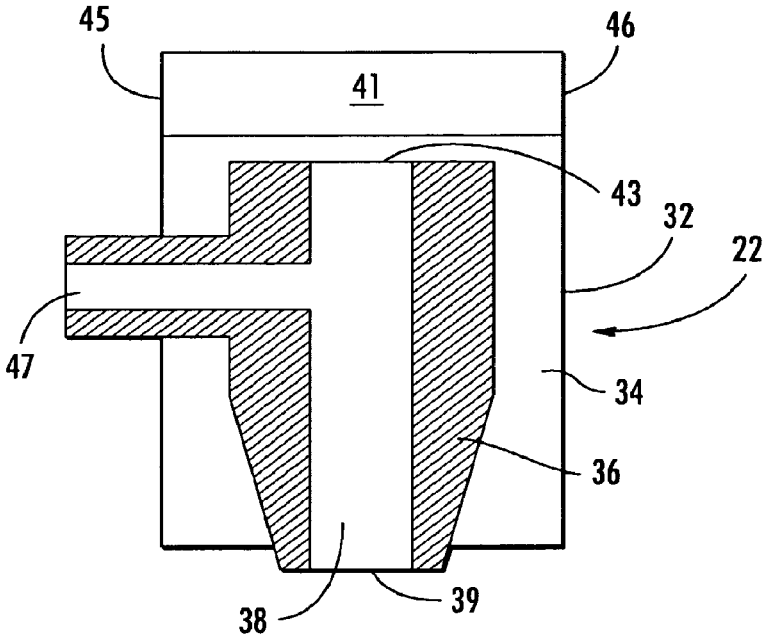
FIG. 2 PRIOR ART
FIG. 2 is a cross-sectional view of a preferred prior art droplet formation means.

FIG. 2 depicts in cross-sectional view a preferred drop formation means 22 of FIG. 1. A housing 32 confines a liquid reservoir 34 within which is disposed a generally cylindrical body member 36 having an open-ended, axial bore 38. One end 39 of bore 38 is open to the exterior of reservoir 34, but the surface tension of the liquid within the reservoir prevents leakage. A piezoceramic transducer 41 forms a part, or all, of the housing wall adjacent the other open end 43 of bore 38. An electrical pulse that is delivered through conductors 45 and 46 produces a deformation of the transducer 41 and that deformation causes a pressure wave to propagate down bore 38. That pressure wave overcomes the viscous pressure loss and the surface tension force of the liquid meniscus at bore end 39, forming a liquid droplet at the end of bore 39, and expelling the droplet into the moving fluid stream. As the transducer returns to its original shape, it draws additional liquid into the bore by way of side conduit 47 which is in fluid communication with liquid source 27. Exemplary drop formation means and control processes incorporating piezoceramic transducers are described in U.S. Pat. Nos. 5,305,015, 5,164,704, 6,537,817, 7,083,112 which are incorporated herein by reference. Additionally, the teachings set forth in the article by Hue P. Le et al, "Progress and Trends in Ink-Jet Printing Technology" Journal of Imaging Science and Technology 42: 49-62 (1998) are incorporated herein by reference.

Figure 3:
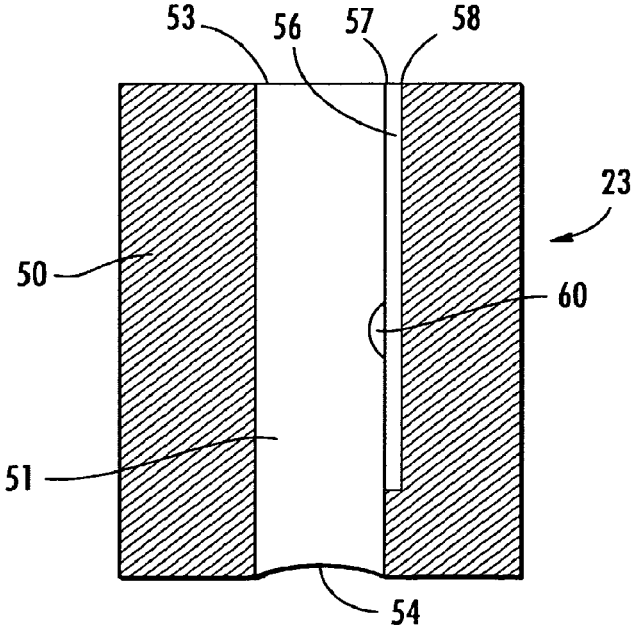
FIG. 3 PRIOR ART
FIG. 3 is a cross-sectional view of an alternative prior art droplet formation means that performs the same function as does the means shown in FIG. 2.

FIG. 3 is a cross-sectional view of another droplet forming device 23 that may usefully be employed in this invention. In its simplest form, it comprises a cylindrical body member 50 with an axial bore 51 having a liquid entry end 53 and a droplet exit end 54 placed within a liquid-filled housing (not shown). A resistance heater 56 is disposed within the bore nearby the exit end. A very brief current pulse, typically lasting a few microseconds, is applied to the heater element 56 by way of conductors 57 and 58. That results in a rise in temperature of the heater which is transferred to the adjacent liquid. When the liquid is superheated to the critical temperature for bubble nucleation, a vapor bubble 60 instantaneously expands. As the bubble expands, it forces some of the liquid out of the exit end 54, forming a tiny droplet that is expelled into the flowing fluid stream. When the bubble collapses a vacuum is created which pulls more liquid into the bore. It is to be noted that the droplet forming devices illustrated in FIGS. 2 and 3 are employed in ink jet printers, and so are commercially available.

In either the embodiment of FIG. 2 or that of FIG. 3, the droplet forming devices employed may be arranged singly, as an array of multiple individual devices, or as a multi-chambered unit. The number of individual droplet forming units and the frequency at which they are activated determine the rate at which liquid is expelled into the flowing fluid stream, thus allowing a precise digital control of the concentration of liquid in the flowing fluid stream.

Multiple or multi-chambered droplet forming devices may contain the same or different liquids including, for example, water, solvents, dopants, chelating agents, or other chemical or biological liquids that can interact with a compound or other material carried in the flowing fluid stream. Liquids that can modify the environment of the materials carried in the flowing fluid so that the materials behave differently, for example move at different speeds due, for example, to increases in size or cross-section of the materials, can also be employed.

In a preferred embodiment, the method and means of this invention are employed in association with a detector system, and in particular, a detector system such as the one described in commonly owned U.S. Pat. No. 7,138,626 which is incorporated herein by reference in its entirety. When used with this, or other, detector systems, liquids may be introduced into an analyte or analyte mixture using the methods and means described herein to modify, or to sequentially change, the chemical composition of the analyte or analyte mixture or of a gas or gas mixture that contains the analyte.

There are a number of different approaches that may be taken to accomplish the desired modifications to an analyte or to a gas stream that may carry an analyte, or is otherwise used in association with a detector system. For example, a dopant may be added to a fluid stream containing molecules of explosives in order to differentiate explosives one from another, and to identify explosives in complex mixtures. More broadly, a liquid chemical may be metered into a fluid stream to selectively react with certain specific analytes or classes of analytes. The products resulting from those reactions may then be monitored and detected, thus allowing a selective and sensitive detection of specific analytes in the presence of other analytes that would ordinarily interfere with the analysis. Further, separate droplet forming means, or arrays of droplet forming means, may be spaced apart along a fluid stream carrying analyte, with optical readers or other devices capable of measuring a characteristic of the analyte that was changed by the introduced liquid droplets disposed between droplet introduction locations.

Further still, there can be one reservoir for a liquid and, associated with that reservoir, multiple droplet formation devices. And, there may be multiple reservoirs, each containing a different liquid and corresponding single or multiple droplet formation devices associated with each reservoir.

In another application, addition of a chemical or other material that selectively induces three-dimensional shape changes in certain proteins, including some viruses, or induces shape changes in certain proteins to a greater extent than to other proteins, may be used with appropriate detection and identification instrumentation to detect and identify particular proteins in a complex mixture.

The method and means of this invention may also be employed to produce reactant ions of particular composition or concentration. An air stream of precisely controlled humidity, for example, may be produced by metering droplets of pure water into a stream of totally dry air at a rate that produces the desired water vapor concentration in the air stream. That humidified air stream may then be passed through a gas discharge device, or other ion producing means, to ionize water molecules and obtain a mixture of ions of known composition and reactivity and to form a reactant ion stream. That reactant ion stream can subsequently and directly ionize a wide variety of chemicals in vapor, liquid, or solid form. Analyte ions so formed may then be collected and transported to a detector means such as a differential mobility spectrometer.

Many other variations of the precision mixing system of this invention will be apparent to those skilled in this art. Additionally, the precision mixing system described herein is not limited to use with detector system set forth in the preferred embodiment, but may also be used for example, to add concentrated essences during food processing or perfume production, or to add drugs or chemicals to kidney dialysis fluid or to blood as it is being circulated through a heart-lung machine.

The invention claimed is:

1. A method for introducing a liquid into a fluid stream comprising:

passing a fluid stream through a confined space connected at a first location to a fluid source and connected at a second location to use point;

injecting a first liquid into the fluid stream within the confined space before the fluid stream reaches the use point, wherein injecting the first liquid into the fluid stream further includes electrically controlling a first droplet forming device to:

generate a pressure wave, deform a transducer, form a liquid droplet at an exit port of the first droplet forming device; and cause the liquid droplet to be expelled into the fluid stream; and sensing a characteristic of the fluid stream before the fluid stream reaches the use point;

signaling the first droplet forming device in accordance with the sensed characteristic; and varying at least one of a size and frequency of expulsion of the liquid droplet in response to the signaling.

2. A method for introducing a liquid into a fluid stream comprising:

passing a fluid stream through a confined space connected at a first location to a fluid source and connected at a second location to use point;

injecting a first liquid into the fluid stream within the confined space before the fluid stream reaches the use point, wherein injecting the first liquid into the fluid stream further includes electrically controlling a first droplet forming device to:

generate a pressure wave, deform a transducer, form a liquid droplet at an exit port of the first droplet forming device; and cause the liquid droplet to be expelled into the fluid stream injecting a second liquid into the fluid stream within the confined space before the fluid stream reaches the use point, wherein injecting the second liquid into the fluid stream further includes electrically controlling a second droplet forming device to:

generate a pressure wave, deform a transducer, form a liquid droplet at an exit port of the second droplet forming device, and expel the liquid droplet into the fluid stream; and sensing a characteristic of the fluid stream before the fluid stream reaches the use point;

signaling at least one of the first droplet forming device and the second droplet forming device in accordance with the sensed characteristic; and varying at least one of a size and frequency of expulsion of the liquid droplet in response to the signaling.

3. A method for introducing a liquid into a fluid stream comprising:

passing a fluid stream through a confined space connected at a first location to a fluid source and connected at a second location to use point;

injecting a first liquid into the fluid stream within the confined space before the fluid stream reaches the use point, wherein injecting the first liquid into the fluid stream further includes electrically controlling a first droplet forming device to:

generate a pressure wave, deform a transducer, form a liquid droplet at an exit port of the first droplet forming device; and cause the liquid droplet to be expelled into the fluid stream injecting a second liquid into the fluid stream within the confined space before the fluid stream reaches the use point, wherein injecting the second liquid into the fluid stream further includes electrically controlling a second droplet forming device to:

apply a current pulse to a resistance heater, cause the temperature in a liquid located within the second droplet forming device to rise, form a vapor bubble in the liquid, and expel a liquid droplet into the fluid stream from an exit port of the second droplet forming device; and sensing a characteristic of the fluid stream before the fluid stream reaches the use point;

signaling at least one of the first droplet forming device and the second droplet forming device in accordance with the sensed characteristic; and varying at least one of a size and frequency of expulsion of the liquid droplet in response to the signaling.

4. A method for introducing a liquid into a fluid stream comprising:

passing a fluid stream through a confined space connected at a first location to a fluid source and connected at a second location to use point;

injecting a first liquid into the fluid stream within the confined space before the fluid stream reaches the use point, wherein injecting the first liquid into the fluid stream further includes electrically controlling a first droplet forming device to:

apply a current pulse to a resistance heater, cause the temperature in a liquid located within the second droplet forming device to rise, form a vapor bubble in the liquid, and expel a liquid droplet into the fluid stream from an exit port of the first droplet forming device;

injecting a second liquid into the fluid stream within the confined space before the fluid stream reaches the use point, wherein injecting the second liquid into the fluid stream further includes electrically controlling a second droplet forming device to:

apply a current pulse to a resistance heater, cause the temperature in a liquid located within the second droplet forming device to rise, form a vapor bubble in the liquid, and expel a liquid droplet into the fluid stream from an exit port of the second droplet forming device; and sensing a characteristic of the fluid stream before the fluid stream reaches the use point;

signaling at least one of the first droplet forming device and the second droplet forming device in accordance with the sensed characteristic; and varying at least one of a size and frequency of expulsion of the liquid droplet in response to the signaling.

5. The method in accordance with claims 1, 2, 3, and 4, further comprising detecting at least one characteristic of the fluid stream at the use point.

6. The method in accordance with claims 1, 2, 3, and 4, wherein the expelled liquid droplet reacts with a component of the fluid stream resulting in a change in the chemical composition thereof.

* * * * *